US005959274A

United States Patent [19]

Perret

[11] Patent Number: 5,959,274

[45] Date of Patent: Sep. 28, 1999

[54] OPERATING MECHANISM FOR HIGH-VOLTAGE CIRCUIT-BREAKERS

[75] Inventor: Michel Perret, Bourgoin-Jallieu, France

[73] Assignee: GEC Alsthom T & D SA, Paris, France

[21] Appl. No.: 08/821,881

[22] Filed: Mar. 21, 1997

[30] Foreign Application Priority Data

Mar. 22, 1996 [FR] France ..... 96 03604

[51] Int. Cl.[6] ..... H01H 33/70

[52] U.S. Cl. ..... 218/78; 218/154

[58] Field of Search ..... 218/4, 92, 93, 218/96, 98, 120, 140, 153, 154, 14, 43, 45, 55–57, 152, 67–68, 78–80

[56] References Cited

U.S. PATENT DOCUMENTS

| | | | |
|---|---|---|---|
| 2,861,144 | 11/1958 | Favre . | |
| 3,214,543 | 10/1965 | Colclaser, Jr. et al. | 218/154 |
| 4,414,449 | 11/1983 | Garzon | 218/153 |
| 5,296,662 | 3/1994 | Engdahl et al. | 218/154 |
| 5,756,952 | 5/1998 | Thuries | 218/154 |

FOREIGN PATENT DOCUMENTS

| | | |
|---|---|---|
| 1003321 | 2/1957 | Germany . |
| 1039601 | 9/1958 | Germany . |
| 2361972 | 5/1975 | Germany . |

OTHER PUBLICATIONS

Maury, Eugene, "Appareillage electrique d'interruption a haute tension," Techniques de L'ingeieur, 3–1976, pp. 43 and 73–88 and English language translation of relevant portions.

*Primary Examiner*—Lincoln Donovan
*Attorney, Agent, or Firm*—Sughrue, Mion, Zinn, Macpeak & Seas, PLLC

[57] ABSTRACT

Operating mechanism for actuating an operating rod (13) of a circuit-breaker including at least one interrupter chamber filled with a pressurized dielectric gas, said operating mechanism using a tripping spring (21) held charged when the circuit-breaker is closed by a selectively operable tripping abutment (23). The operating mechanism has a resetting member formed by a member (34) moving through a wall of a sealed and closed enclosure (32) communicating with the pressurized interrupter chamber.

3 Claims, 8 Drawing Sheets

"CLOSED"

"OPEN"

OPERATING MECHANISM FOR HIGH-VOLTAGE CIRCUIT-BREAKERS

BACKGROUND OF THE INVENTION

The present invention concerns an operating mechanism for high-voltage circuit-breakers in which the interrupter chamber is filled with a gas having good dielectric properties, such as sulfur hexafluoride, at a pressure of a few bars.

Mechanical operating mechanisms using springs and hydraulic operating mechanisms for operating such circuit-breakers are known in themselves.

For an illustration of the state of the art, reference may be had to TECHNIQUES DE L'INGENIEUR, (Engineering Techniques) high voltage electrical switching device by Eugene MAURY, D 655 a.

BRIEF SUMMARY OF THE INVENTION

An aim of the present invention is to provide a circuit-breaker having a combined pneumatic and mechanical operating mechanism in which the gas used for some maneuvers of the circuit-breaker is the pressurized insulative gas in the interrupter chamber.

The invention consists in an operating mechanism as defined in the claims.

BRIEF DESCRIPTION OF THE DRAWINGS

The invention is explained by means of an embodiment described hereinafter with reference to the accompanying drawing in which.

DETAILED DESCRIPTION OF THE INVENTION

Figure 1:
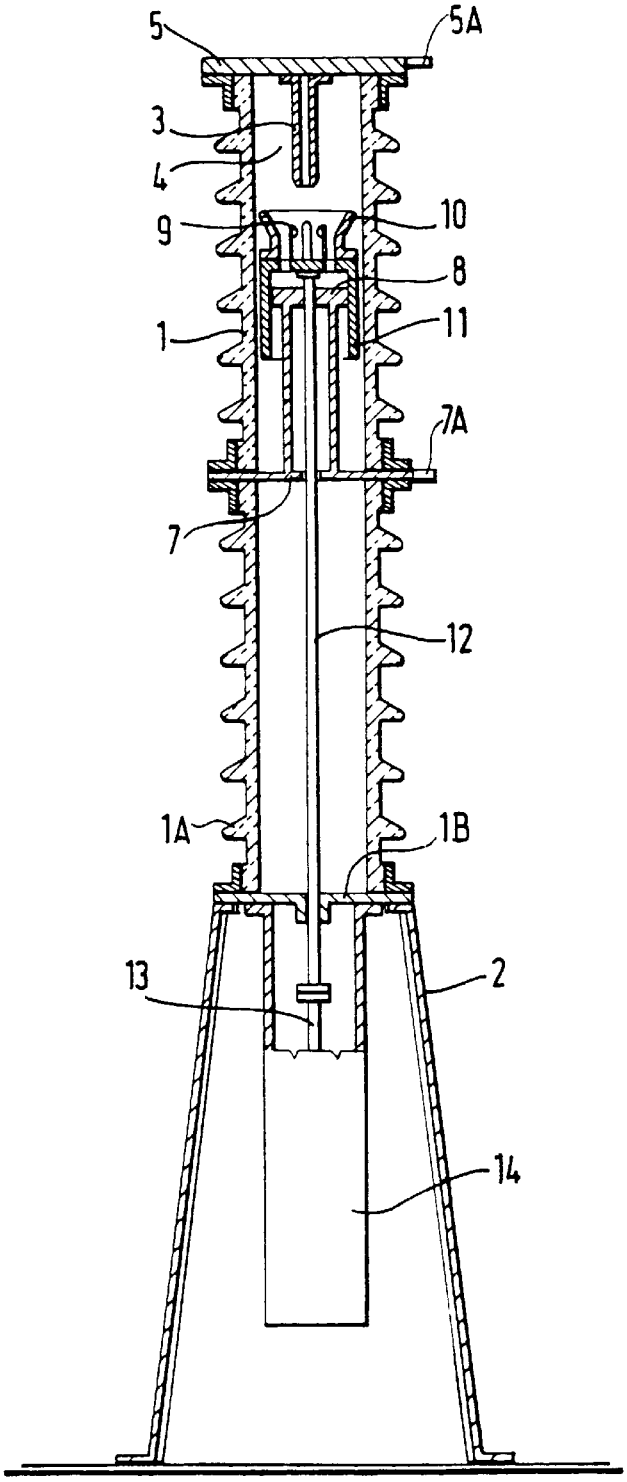
FIG. 1 is an elevation view of a circuit-breaker pole of the invention.

FIG. 1 shows a circuit-breaker pole in elevation.

In this figure, the reference number 1 designates an insulative column of a circuit-breaker pole. The column rests on a chassis 2 fixed to the ground, through the intermediary of an insulative column 1A provided with a bottom metal flange 1B.

A fixed contact 3 is disposed in the interrupter chamber 4 filled with insulative gas such as sulfur hexafluoride $SF_6$.

The chamber 4 is delimited at the top by a first flange 5 to which is fixed a first terminal 5A and at the bottom by a second flange 7 to which is fixed a second terminal 7A.

The reference number 8 designates a fixed puffer piston. The mobile assembly comprises contacts 9 and a nozzle 10 attached to a cylinder 11 cooperating with the piston 8. The cylinder is coupled to an operating rod 12 which passes through the flange 7, to which it can be sealed or not.

The rod 12 is coupled to a rod 13 which is part of the operating mechanism shown by the rectangle 14 in FIG. 1.

The operating mechanism is fixed to the chassis 2 by means that are not shown; it is disposed directly under the pole to be operated.

Figure 2:
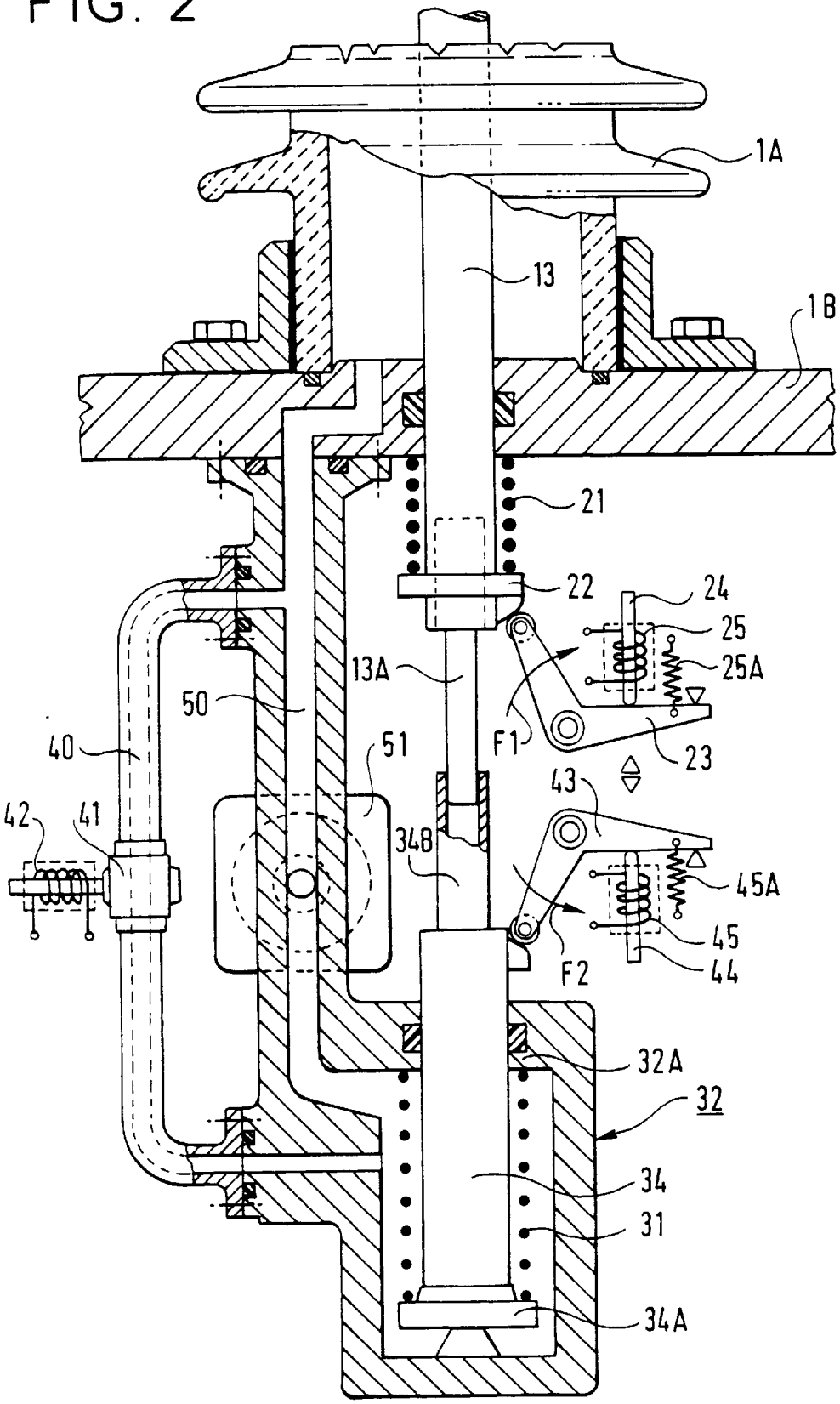
FIG. 2 is a schematic view of the operating mechanism of the circuit-breaker, shown in a set position.

Refer now to FIG. 2 which shows an operating mechanism of the invention in schematic axial section, in the configuration corresponding to the circuit-breaker set in normal operation.

The operating mechanism includes a first or tripping spring 21 bearing against the bottom flange 1B and against a ring 22 attached to the rod 13. The rod is immobilized, the spring 21 being compressed, by an abutment 23 that can be retracted by an electromagnet comprising a rod 24 actuated by a tripping coil 25. A return spring 25A and end stops shown by triangles with no reference number complete the equipment of the abutment 23. An abutment of this kind is described in the document FR-A-95 13 796, for example.

The operating mechanism includes a cylindrical rearming member 34 passing through a wall 32A of an enclosure 32 to which it is sealed. A weak spring 31 is disposed around the member 34 and bears on the top inside wall 32A of the enclosure 32 and on a shoulder 34A on the cylindrical member 34. The member 34 is coaxial with the operating rod 13.

In the position shown in FIG. 2, with the circuit-breaker set, the spring 31 is relaxed and the member 34 occupies all of the length of the enclosure 32. The enclosure is connected to the interior of the column 1A filled with pressurized insulative gas by two pipes 40 and 50.

The pipe 40 can be closed off by a valve 41 that can be operated by an electromagnet including a coil 42, for example.

The pipe 50 incorporates a small pneumatic pump 51 for producing a flow in the direction from the enclosure 32 to the column 1A.

When the circuit-breaker is set, as in FIG. 2, the valve 41 is open. The pressure in the enclosure 32 is equal to that in the column 1A, which is a few atmospheres. The cylindrical member 34 is subjected to a force equal to the quotient of the differential pressure between the inside and the outside of the enclosure to the cross-section of the cylindrical member. This force tends to move the member 34 upwards against the action of the spring 31. The movement is prevented by an abutment 43 that can be retracted by an electromagnet comprising a rod 44 actuated by a tripping coil 45. The equipment of the abutment 43 is completed by a return spring and by end stops symbolized by triangles with no reference numbers.

The rod 13 and the cylindrical member 34 are respectively extended by a rod 13A and a tube 34B, engaged one within the other. These members are such that during tripping the rod 13A moves without impediment and during resetting the tube 34B entrains the rod 13A. One embodiment of this arrangement is shown in FIGS. 6 through 13.

An instruction to open the circuit-breaker energizes the tripping coil 25, which retracts the abutment 23 as the result of rotation in the direction of the arrow F1. The spring 21 relaxes, entraining the circuit-breaker operating rod.

Figure 3:
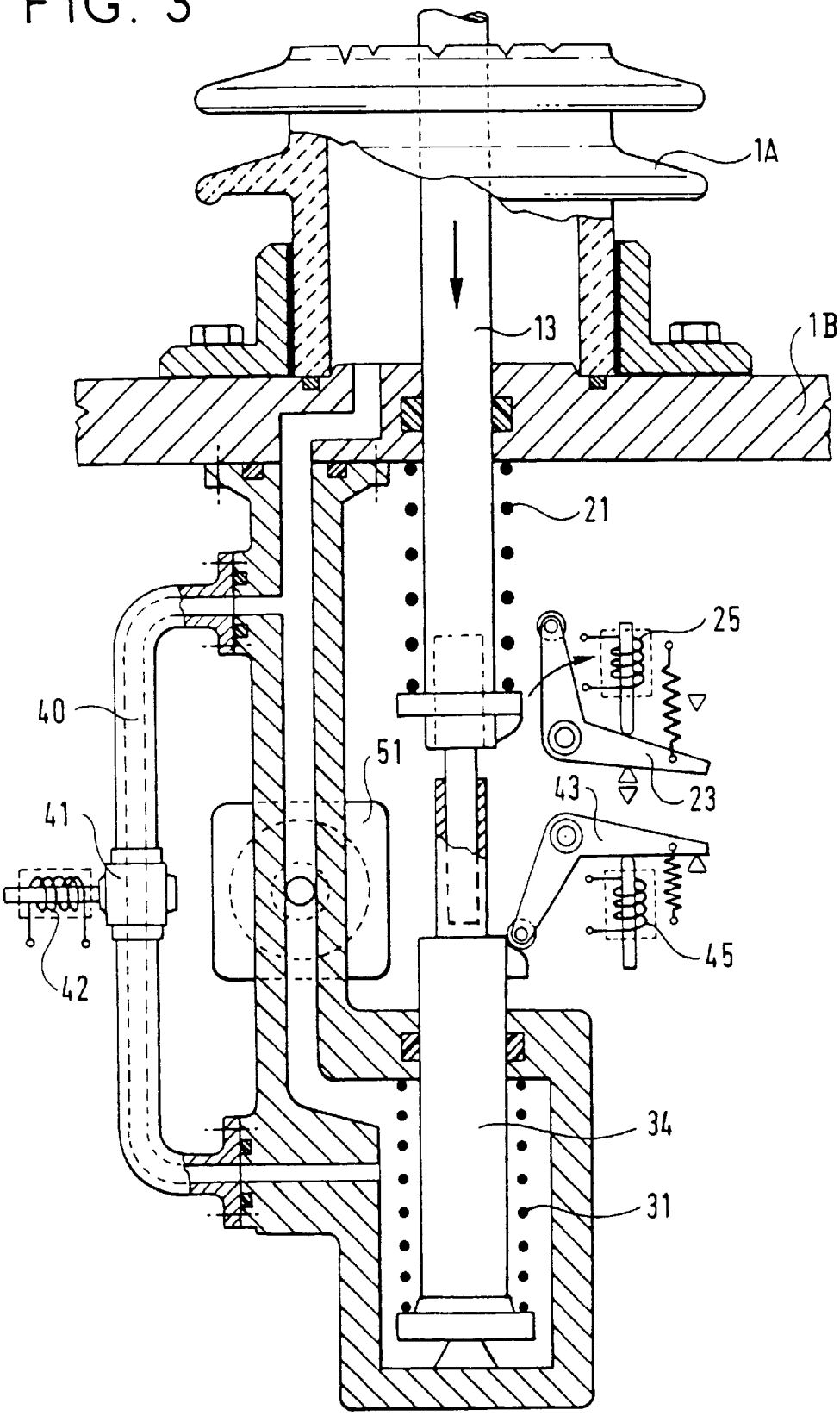
FIG. 3 is a schematic view of the operating mechanism after a tripping operation.

FIG. 3 shows the configuration of the operating mechanism after tripping.

Figure 4:
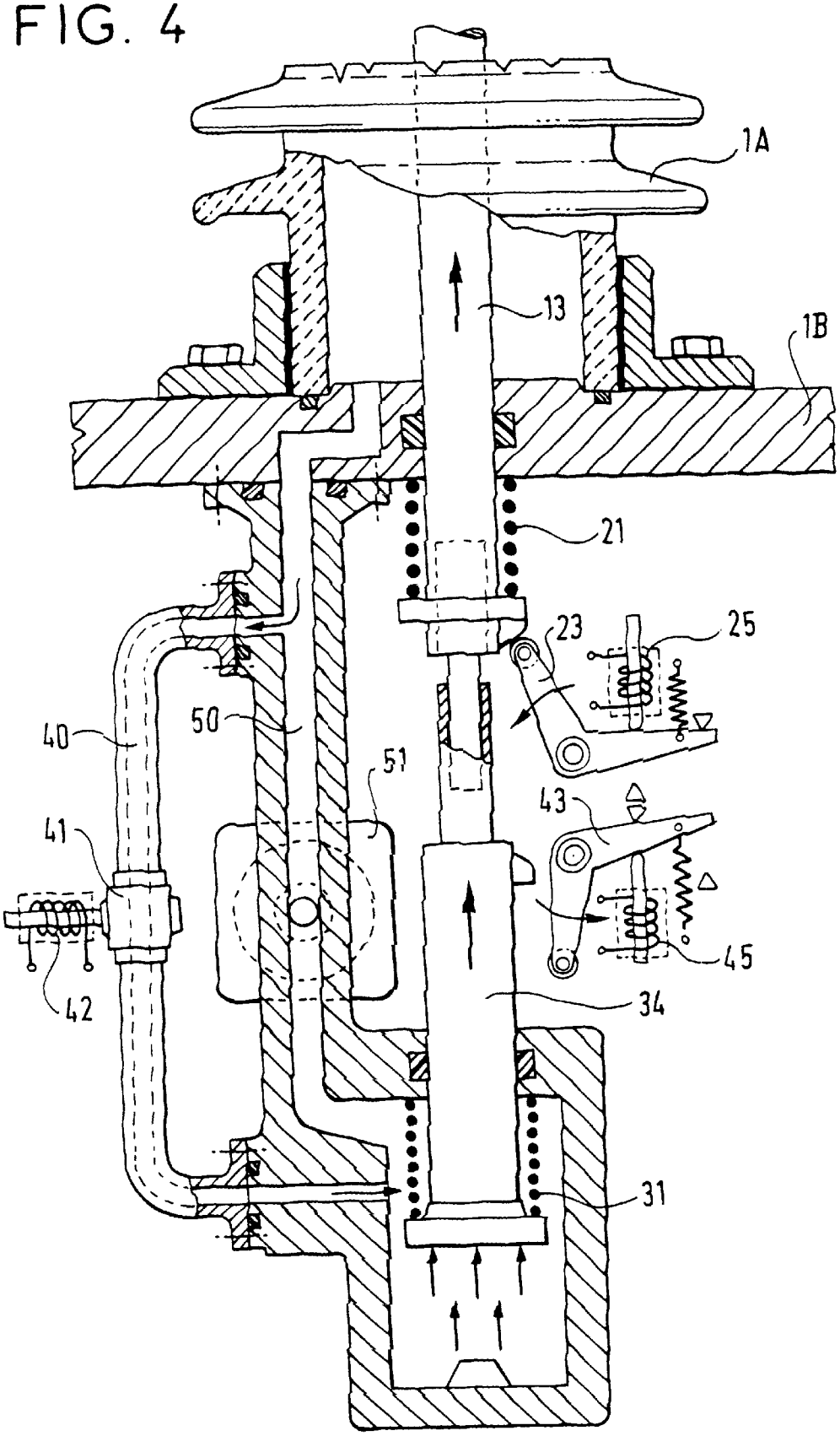
FIG. 4 is a schematic view of the operating mechanism after a rest maneuver

Within a very short time period, less than 0.3 seconds, a reset instruction is issued. This energizes the reset coil 45 which retracts the abutment 43 by rotation in the direction of the arrow F2. Because of the pressure difference operating on the member 34, the latter moves upward in FIG. 3, compressing the spring 31 and entraining the rod 13–13A, which recloses the circuit-breaker and recompresses the spring 21. The rod 13 hooks onto its abutment 23. After the reset maneuver, has been performed the operating mechanism has the configuration of FIG. 4. The coil is energized at the start of the reset operation at a time calculated so that, given the response times of the various mechanical parts, the reclosing is effected 0.3 seconds after opening. To allow the reset maneuver that has just been described, the cross-section of the member 34 is greater than that of the rod 13, for example a diameter of 80 mm to 100 mm for the member 34, compared to 40 mm for the rod 13.

If the fault persists, an open instruction is immediately issued and energizes the tripping coil 25. The spring 21 relaxes, entraining the rod 13 and consequently opening the circuit-breaker.

Figure 5:
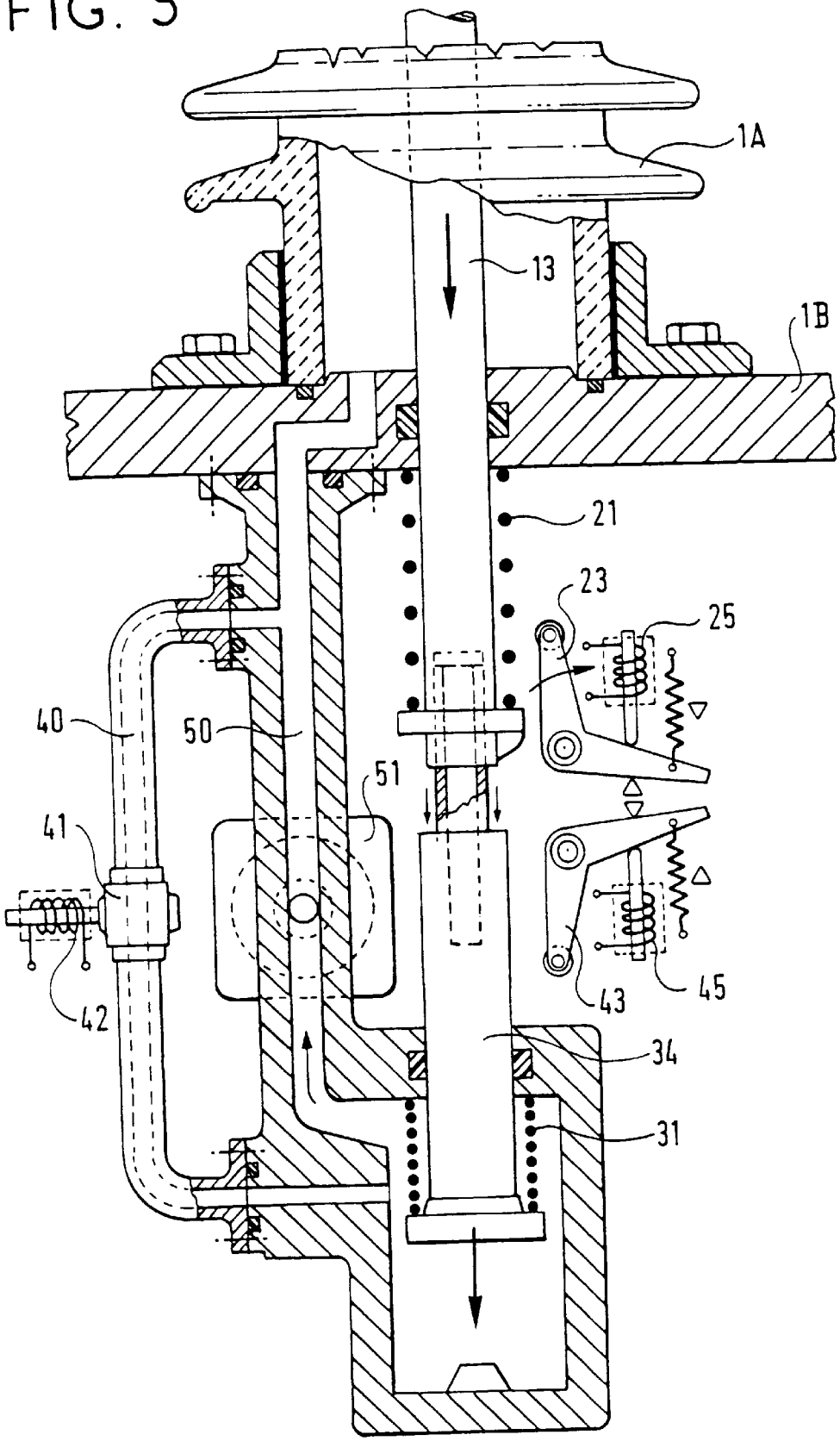
FIG. 5 is a schematic view of the operating mechanism after the second tripping maneuver of a O,0.3sC,O cycle.

After this O,0.3sC,O cycle the operating mechanism is in the configuration of FIG. 5.

The specification states that after a time period of 10 seconds, for example, the operating mechanism must be able to carry out a cycle comprising a closing C followed by an opening O.

For the operating mechanism to carry out this cycle, the member 34 must resume its initial position (FIGS. 2 and 3).

To allow this, at the end of the O,0.3sC,O cycle, an instruction is issued to energize the coil 42 which causes the valve 41 to be closed. As soon as this valve is closed, the vacuum pump 51 is started; in a few seconds, pressure in the enclosure 32 is reduced to a sufficiently low value for the member 34 to resume its initial position, due to the differential pressure resulting from the difference between atmospheric pressure and the residual pressure in the enclosure 32, assisted by the spring 31. The abutment 43 is redeployed. The pump 51 is stopped and the valve 41 opened. The operating mechanism is then ready for a new C-O) cycle.

FIGS. 6 through 13 show the construction and operation of the rod 13 and the member 34.

The rod 13 terminates in a portion 13A of smaller diameter. A conical portion 13B separates the two portions of the rod. The larger diameter portion is attached to a cylinder 61.

The member 34 is a rod extended by a tubular portion 34B. This rod slides through the wall 32A of the enclosure 32 previously described, to which it is sealed. The tubular portion carries at its end housings for balls 52, for example three balls spaced by 120° from each other.

A mobile tube 55 surrounds the rod 13A and the tubular portion 34B. The inside diameter of the tube 55 is such that the tube comes into contact with the balls 52 when the latter bear on the portion 13B of the rod 13.

The tube 55 has at the end near the cylinder 61 an inside conical ramp 55A so that the thickness of the tube at the end facing the cylinder 61 is less than that of the remainder of the tube. The diameter of the cylinder 61 is such that the tube 55 can bear against the end of the cylinder to enable the tube 55 to push the cylinder 51.

The tube 55 carries a ring 56 on which bears one end of a spring 57 the other end of which bears on the wall 32A. The spring is surrounded by a sleeve 58 with one end fixed to the wall 32A and the other end carrying a ring 59.

Figure 6:
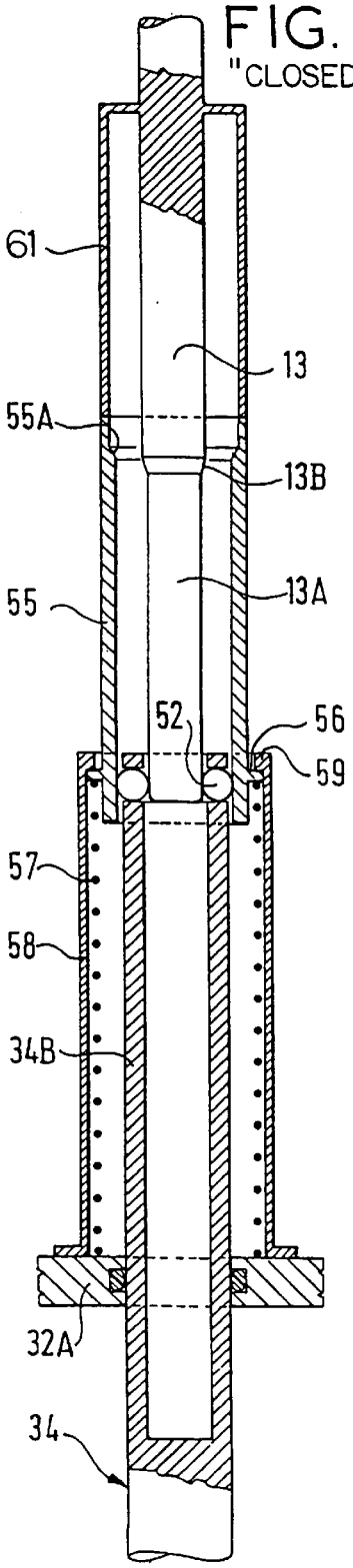
FIGS. 6 through 13 show the various phases of the operation of the operating mechanism in one particular embodiment.
Figure 7:
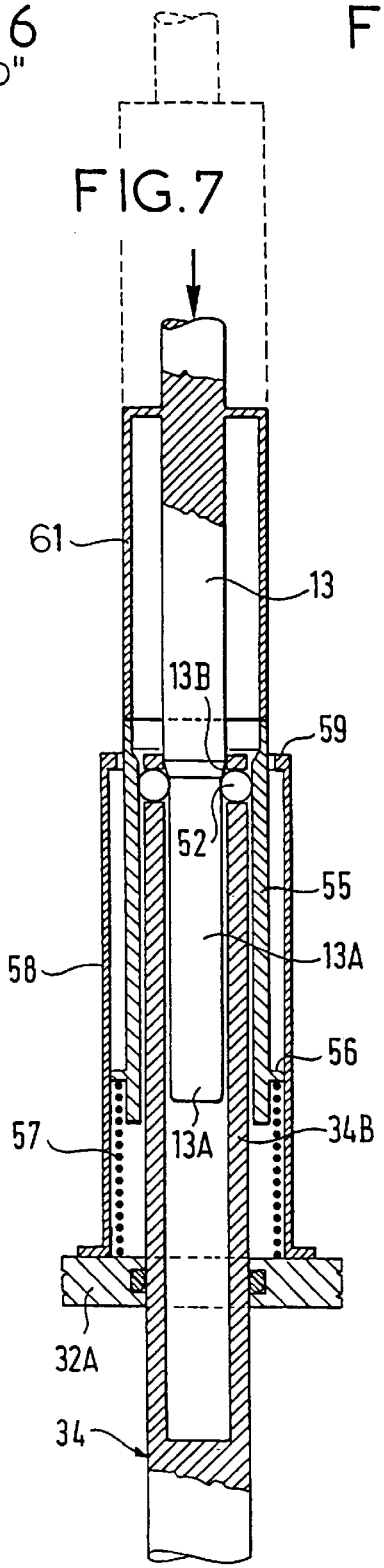

FIG. 6 corresponds to a configuration in which the circuit-breaker is closed. The tube 55 is in contact with the cylinder 61, the spring 57 is relaxed, the end of the tubular portion 34B is engaged around the end of the rod 13A and the balls are in simultaneous contact with the rod 13A and with the tube 55.

Opening of the circuit-breaker (FIG. 7) is manifested by the displacement of the rod 13–13A to the right by the tripping spring described above. The spring 57 is compressed. At the end of the opening maneuver, the balls 52 are on the ramp 13B and near the ramp 55A.

Figure 8:
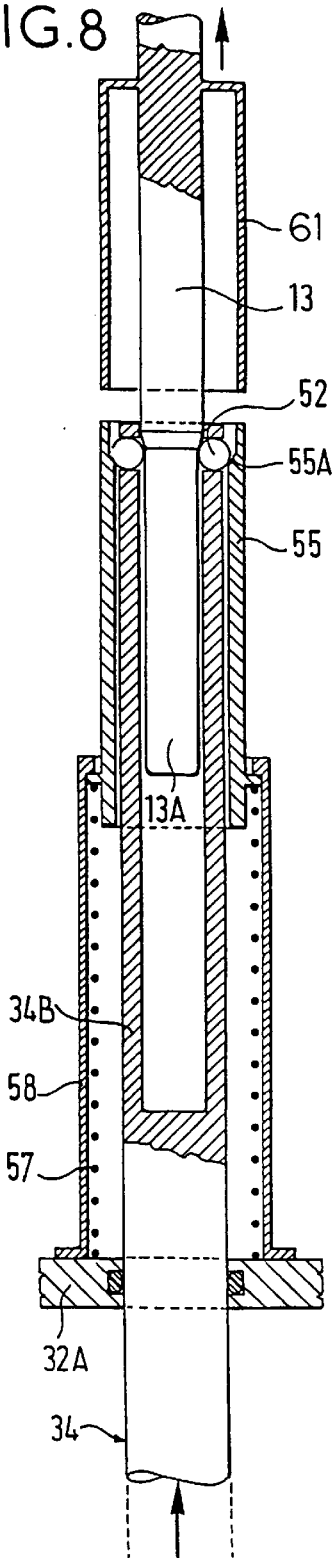
Figure 9:
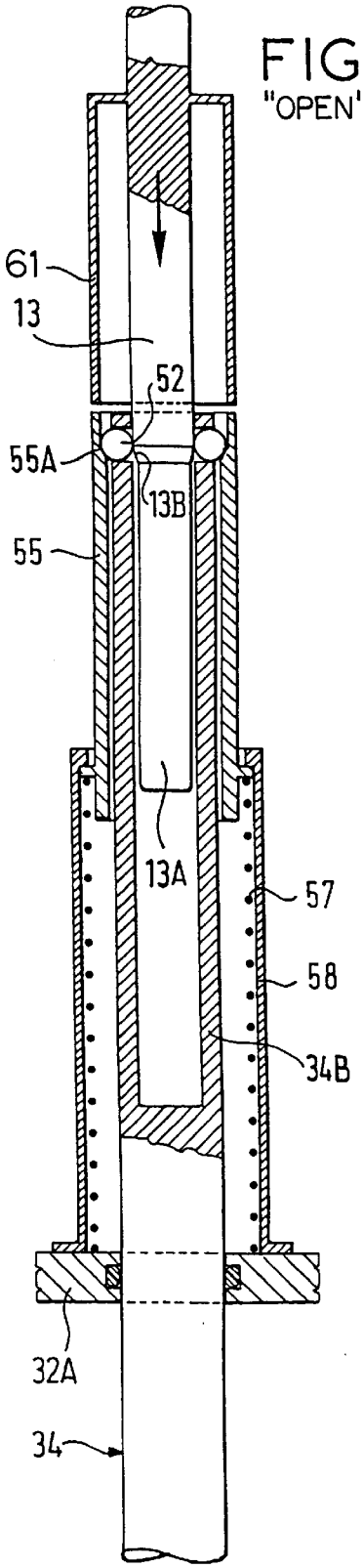

A reset maneuver is manifested by movement towards the left of the rod 34 which pushes the rod 13A because at this time the balls bear on the conical part 13B and are trapped by the tube 55. Pushed by the spring 57, the tube 55 tracks this movement. When the ring 56 reaches the ring 59 the tube 55 stops moving. The rod 34B continues to move a few millimeters, enabling the balls to rise up the ramp 13B and to separate the parts 13–13A and 34B (FIG. 8). The movement of the member 34–34B includes an overshoot of a few millimeters (12 mm, for example) to enable the abutment for catching the rod 13–13A to resume its position. The configuration is then that of FIG. 9.

Figure 10:
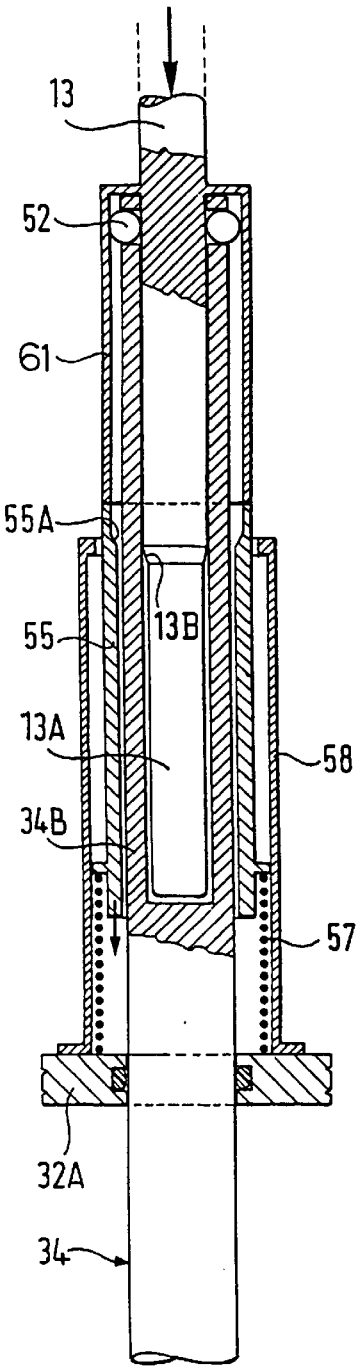

As the balls 52 have been released, there is nothing to prevent reopening of the circuit-breaker. As previously, this is manifested by the movement of the rod 13–13A, the rod 34–34B remaining immobile during the latter's travel (FIG. 10).

Figure 11:
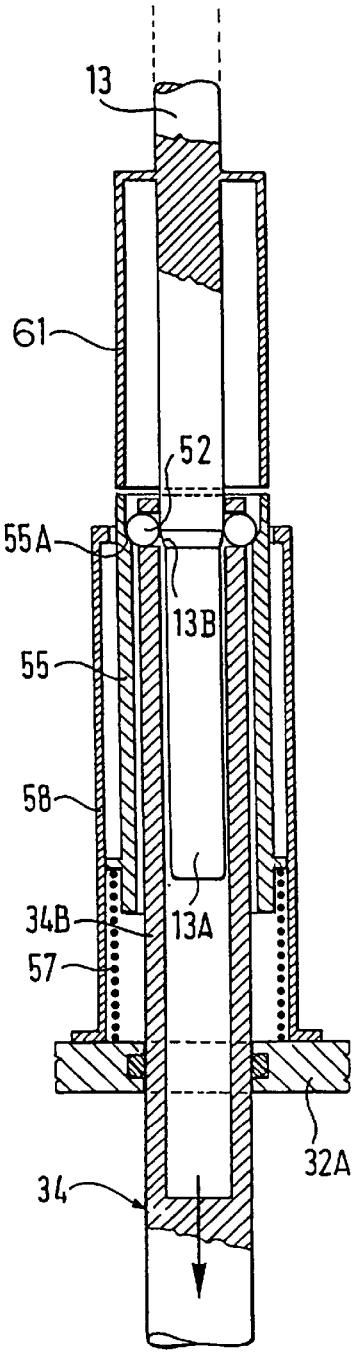
Figure 12:
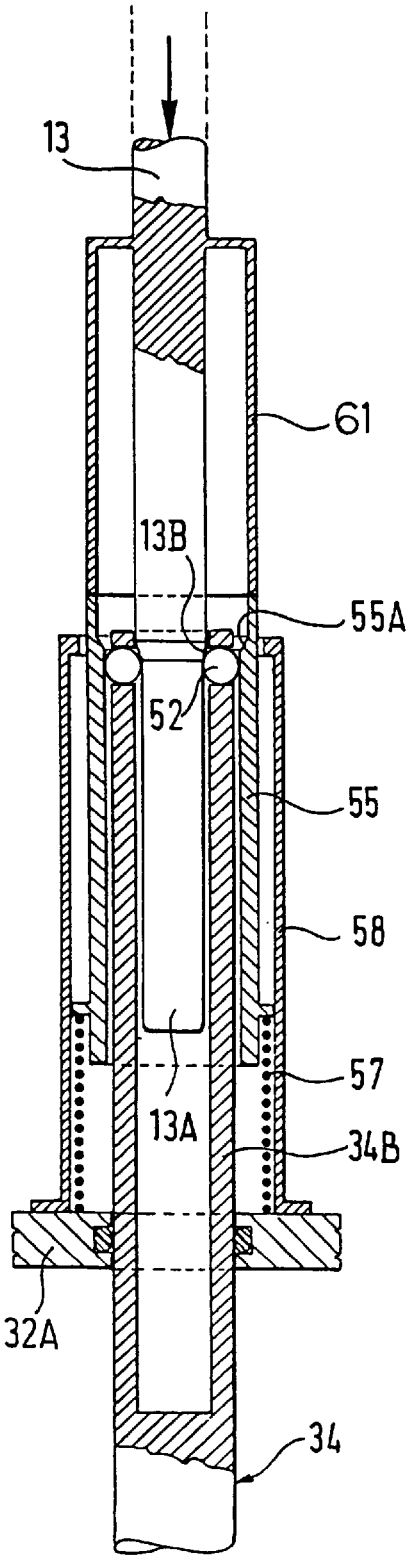

Rearming is effected by moving the rod 34–34B to the right, as seen in the figure (FIG. 11). At the start of its travel, the tube 55 remains immobile. When the balls 52 reach the ramp 13A (FIG. 12), the tube 55 is entrained in turn, compressing the spring 57. A slight overshoot (3 mm, for example) enables the reset abutment to resume its position.

Figure 13:
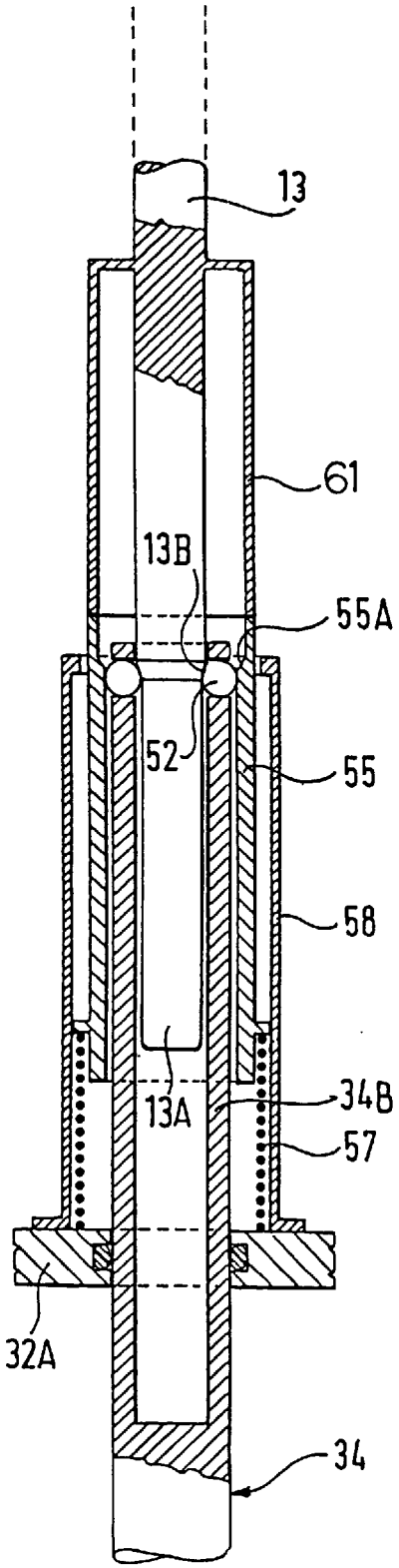

At the end of the rearming maneuver the operating mechanism is in the configuration of FIG. 13, ready to carry out a closing maneuver.

The operating mechanism of the invention is simple and inexpensive in terms of manufacture and operation. It has applications in the operation of high-voltage and very-high-voltage circuit-breakers.

I claim:

1. An operating mechanism for actuating an operating rod (13) of a circuit-breaker comprising at least one interrupter chamber filled with a pressurized dielectric gas, said rod passing through an end flange (1B) of the circuit-breaker, to which said rod is sealed, said operating mechanism comprising:

a tripping spring (21) held charged when the circuit-breaker is closed by a selectively operable tripping abutment (23),; and a resetting system comprising a closed and sealed enclosure (32) communicating with a pressurized interrupter chamber via a first pipe (40) that can be closed off by a valve (41) and via a second pipe (50) in which there is disposed in series a vacuum pump (51), the resetting system further comprising a resetting member (34) sliding within said enclosure, to which said resetting member is sealed, and spring loaded towards the inside of the enclosure by a spring (31), said resetting member being associated with a selectively operable resetting abutment (43), said resetting member being disposed on the axis of said rod (13), said resetting abutment member (43) being adapted to allow resetting of the circuit breaker without impeding a subsequent tripping operation.

2. The operating mechanism according to claim 1 wherein said resetting member (34) is a rod having a cross-section where it passes through the wall (32A) of said enclosure (32) much larger than the cross-section of the operating rod (13) where it passes through said end flange (1B).

3. Operating mechanism according to claim 1 characterized in that the resetting member (34) is a rod extended by a tubular portion (34B) provided at its end with orifices for balls (52), said operating rod (13) being extended by a portion (13A) of smaller diameter separated by a conical ramp (13B), a tube (55) being disposed around said tubular portion (34B) and said rod (13A), the inside diameter of said tube (55) being such that sliding with an easy fit is achieved when the balls (52) are in a section of the smaller diameter part (13A) of the operating rod, said tube (55) having a conical end (55A) so that when the balls (52) are in line with this conical end and with said conical ramp (13B), movement of the resetting member (34–34B) in the direction of resetting of the circuit-breaker causes the operating rod (13–13A) to be moved in the setting direction, the operating mechanism further comprising a fixed sleeve (58) around the cylinder (55) and the cylindrical part (34B) of the resetting member, said sleeve including at a first end a ring (59) cooperating with an outside ring (56) on the cylinder (55), a spring (57) being disposed between said outside ring and the second end of the sleeve (58).

* * * * *